US009044877B2

(12) United States Patent
Ames

(10) Patent No.: US 9,044,877 B2
(45) Date of Patent: Jun. 2, 2015

(54) METHOD OF CREATING VESSELS WITH A NOISE CHAMBER

(71) Applicant: Ashley Lin Pottery, LLC, Chicago, IL (US)

(72) Inventor: Ashley Lin Ames, Chicago, IL (US)

( * ) Notice: Subject to any disclaimer, the term of this patent is extended or adjusted under 35 U.S.C. 154(b) by 112 days.

(21) Appl. No.: 13/968,871

(22) Filed: Aug. 16, 2013

(65) Prior Publication Data

US 2014/0048986 A1 Feb. 20, 2014

Related U.S. Application Data

(60) Provisional application No. 61/684,527, filed on Aug. 17, 2012.

(51) Int. Cl.

| | |
|---|---|
| ***B28B 1/26*** | (2006.01) |
| ***B28B 1/00*** | (2006.01) |
| ***B28B 11/00*** | (2006.01) |
| ***B28B 11/24*** | (2006.01) |

(52) U.S. Cl.

CPC . *B28B 1/002* (2013.01); *B28B 1/26* (2013.01); *B28B 1/261* (2013.01); *B28B 11/006* (2013.01); *B28B 11/243* (2013.01)

(58) Field of Classification Search

CPC ..... B28B 1/002; B28B 1/26; C04B 33/28; C04B 2235/6027

USPC ..... 264/651

See application file for complete search history.

(56) References Cited

U.S. PATENT DOCUMENTS 2,839,209 A * 6/1958 Lester et al. ..... 215/13.1

OTHER PUBLICATIONS

Disclosure of Cup with Noise Chamber and Method of Making.

* cited by examiner

*Primary Examiner* — Joseph S Del Sole
*Assistant Examiner* — Russell Kemmerle, III
(74) *Attorney, Agent, or Firm* — Hitchcock Evert LLP

(57) ABSTRACT

A method for creating a vessel with a noise chamber comprising casting slip into a mold defining a vessel with a void in the foot, controlling the hardening process to facilitate the foot becoming leather-hard prior to the other parts of the vessel, placing a bead within the void in the foot, attaching a foot slab with a hole to the foot of the vessel to create a noise chamber out of the void in the foot, drying the vessel beyond a leather-hard state, applying a temporary cover to the hole in the foot slab, glazing the vessel, firing the vessel and applying a seal to the hole in the foot slab.

19 Claims, 4 Drawing Sheets

METHOD OF CREATING VESSELS WITH A NOISE CHAMBER

CROSS-REFERENCE TO RELATED APPLICATION

This application claims the benefit of priority from U.S. Provisional Patent Application No. 61/684,527 filed on Aug. 17, 2012, which is incorporated herein by reference.

FIELD OF THE DISCLOSURE

The invention relates to methods of making ceramic vessels. Specifically, the invention relates to methods of making ceramic vessels having a noise chamber. Some embodiments of the invention further relate to methods to slip cast clay vessels having a noise chamber containing a noise making item.

BACKGROUND

Methods of making pottery by hand have been known for years. Processes for making pottery vessels by hand are tedious and time consuming. Accordingly, methods for casting pottery using molds have been developed.

One method for making a vessel involves pouring the slip or liquefied clay into a one-piece mold and allowing the clay to set within the mold. Once the slip has stiffened, the excess slip may be trimmed away from the rim of the vessel while it remains in the mold. The clay remains in the mold until the vessel is beyond the leather-hard state. The leather-hard state is a point in the drying process wherein the clay has lost approximately 13-23% of its moisture, wherein the person may apply pressure without warping the form while adding elements to the vessel or trimming clay from the vessel. Once it has dried beyond the leather-hard state, the vessel is carefully removed from the mold. Once removed from the mold the vessel may be glazed and fired to finalize the process.

Recently, a hand-made vessel has been developed having a semi-enclosed extended foot which acts as a chamber. The chamber contains one or more clay pellets that make a noise when the vessel shakes. The hand-made vessel had a probability of cracking at the foot and/or along the bottom of the vessel. In addition, during the process of making the vessel the clay pellets may adhere to the clay of the vessel limiting the pellets free movement within the sound chamber of the vessel and therefore limiting the capabilities of the noise feature. If pellets adhere to the vessel, it may require additional steps to free the pellets within the void, which may further harm the development of the vessel. Finally, during use and/or cleaning of the vessel, water or other liquids would collect within the voided section. This liquid would muffle or otherwise interfere with the noise feature and has the potential to cause other negative results.

SUMMARY

The present disclosure provides a method for making pottery with a noise chamber. In some embodiments of the method, one or more molds may be used to create the components that make up the final vessel. Some embodiments use a multi-part mold to define the overall shape of the vessel including a foot with a void or hollow space.

In some embodiments, a liquid clay mixture, referred to as "slip," is poured into a mold. The mold design defines a void in the foot section of the vessel. Once the slip has sufficiently cast in the mold, the excess slip is removed from the mold.

The cast slip hardens at least partially in the mold upside down. The portion of the mold on the foot section is removed once the clay has reached the leather-hard state and/or immediately preceding the leather-hard state. Beads are placed in the void in the foot section. A foot slab is created with a center hole that extends completely through the foot slab, allowing for the passage of air. Once the foot rim of the vessel and the foot slab are leather-hard, they are scored and slipped, and then they are attached together. A gradual concavity is made in the foot slab, such that only a portion of the foot slab at or near the outer edge of the foot slab will contact with a surface. The foot section is covered to slow the drying process. Once the vessel is beyond the leather-hard state, the remaining mold is removed. The vessel is dried in a slow manner. The vessel may also be bisque fired in preparation of a glazing process. Once dried sufficiently for the glazing process, a temporary seal is applied to the hole in the foot slab, and glaze is applied to the vessel. The vessel is kiln fired. A seal is applied to the hole in the foot slab for use.

In some embodiments, the beads are made of a similar material to the vessel. The slip may be poured into a mold for creating multiple beads. The beads may be high-fired to harden them prior to placement in the void of the foot section of the vessel.

In some embodiments, one or more foot slabs are created using one or more molds. The molds for the foot slab are designed to correspond to the foot of the vessel as molded. In some embodiments, the foot slab may be designed to resemble two round disks of clay with the bottom disk corresponding to the outer width of the vessel's foot and the top disk corresponding to the inner width of the vessel's foot.

Additional aspects, advantages and features of the present disclosure are included in the following description of exemplary examples thereof, which description should be taken in conjunction with the accompanying figures, wherein like numerals are used to describe the same feature throughout the figures.

A BRIEF DESCRIPTION OF THE DRAWINGS

DETAILED DESCRIPTION

Figure 1:
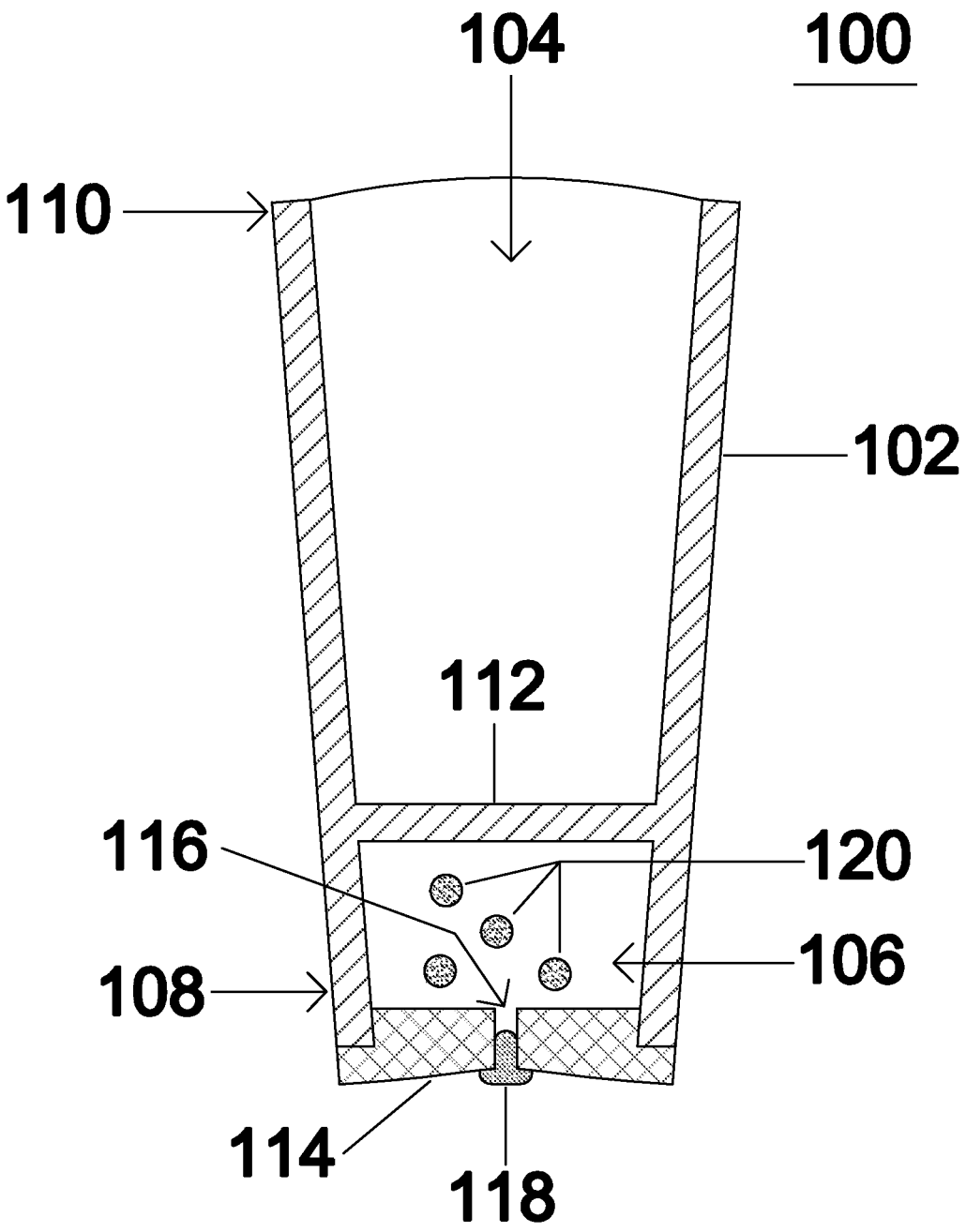
FIG. 1 is a cross-sectional view of a vessel with a noise chamber.

FIG. 1 depicts a cross-sectional view of a vessel 100 with a noise chamber 106. The vessel 100 is comprised of a vessel body 102 defining an open chamber 104 above the noise chamber 106. The vessel 100 includes a foot 108 at the bottom with a lip 110 at the top and a chamber separator 112 between the open chamber 104 and the noise chamber 106. Attached to the foot 108 of vessel 100 is a foot slab 114 having an opening 116. Stopper 118 provides a seal for the opening 116 in order to prevent liquid from entering noise chamber 106. Beads 120 are located within the noise chamber 106 such that they may freely move within the noise chamber 106. The beads 120 bounce within the noise chamber 106 to create a rattling noise when the vessel 100 is shaken. One skilled in the art will recognize that the shape, size, material, and/or other attributes may vary and remain within the scope and spirit of the present disclosure.

Figure 2:
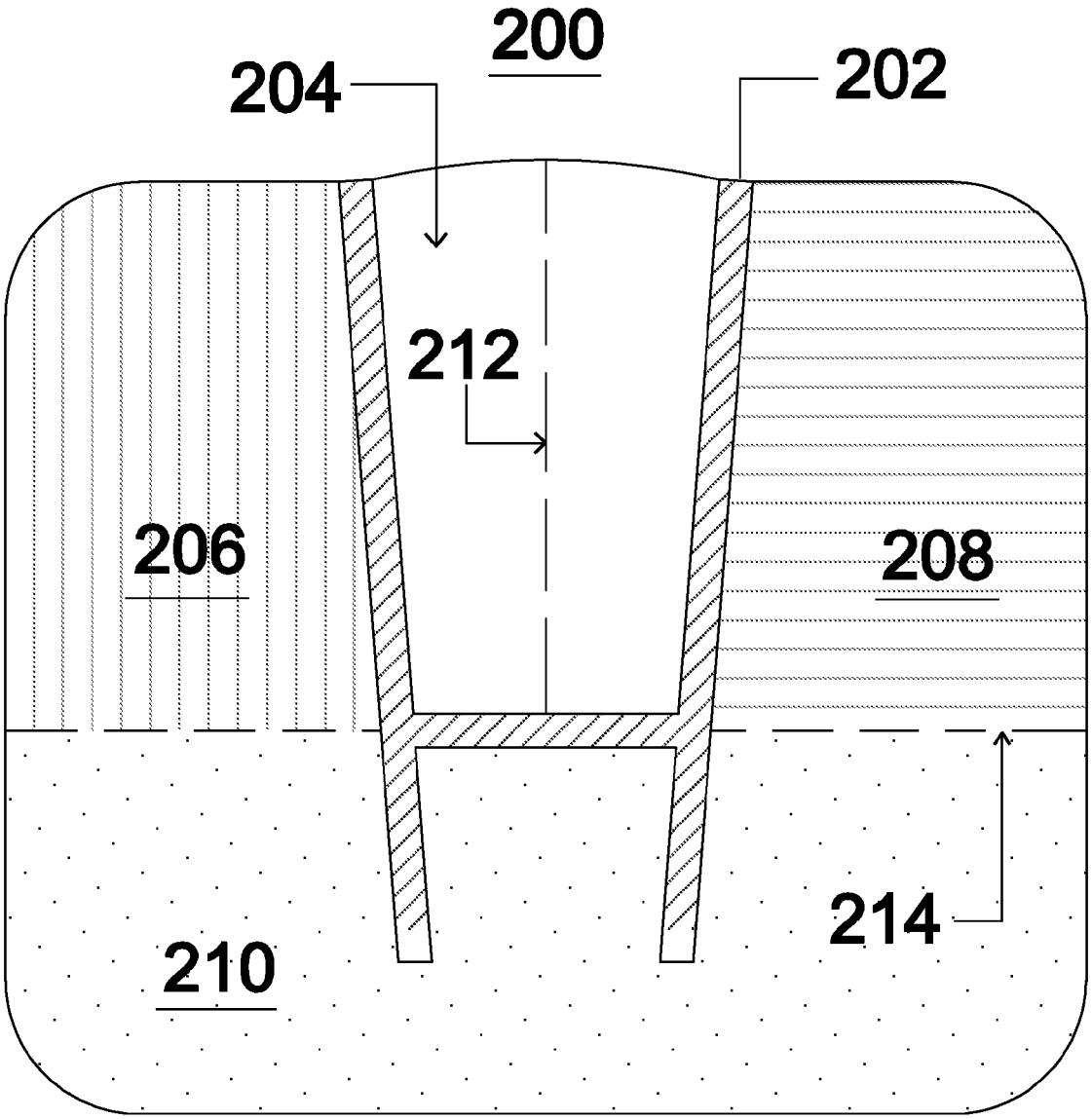
FIG. 2 is a cross-sectional view of a mold for making a vessel with a noise chamber.

FIG. 2 depicts a cross-sectional view of a mold 200 for making vessel body 202. Inside the vessel body 202 is open chamber 204. In this embodiment, mold 200 is made of three components: a first side mold 206; a second side mold 208; and a foot mold 210. The side molds 206 and 208 define the top portion of the vessel body 202. The foot mold 210 defines the bottom of the vessel body 202 including the void in the foot section of the vessel used for making the noise chamber. The three components of the mold 200 define the vessel body 202 when assembled together. The mold 200 may be disassembled leaving the hardened vessel body 202 in tact for further manipulation. Side molds 206 and 208 may be separated along line 212, and the foot mold 210 may be separated from side molds 206 and 208 along line 214. One skilled in the art will recognize that the mold 200 may vary to correlate with various designs of vessel body 202 and remain within the scope and spirit of the disclosure.

Figure 3A:
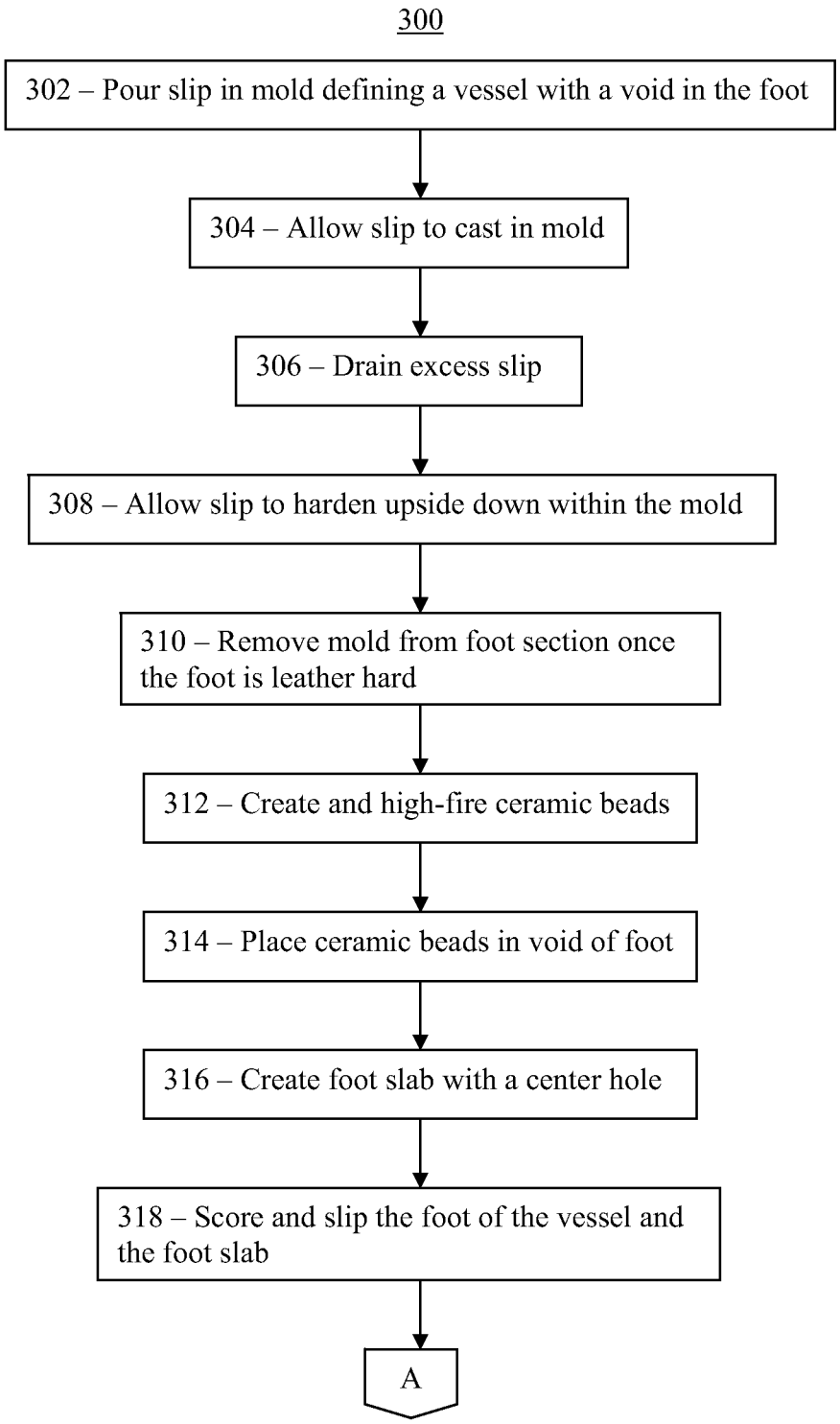
FIG. 3A is a chart depicting the first part of an embodiment of a process of the disclosure.
Figure 3B:
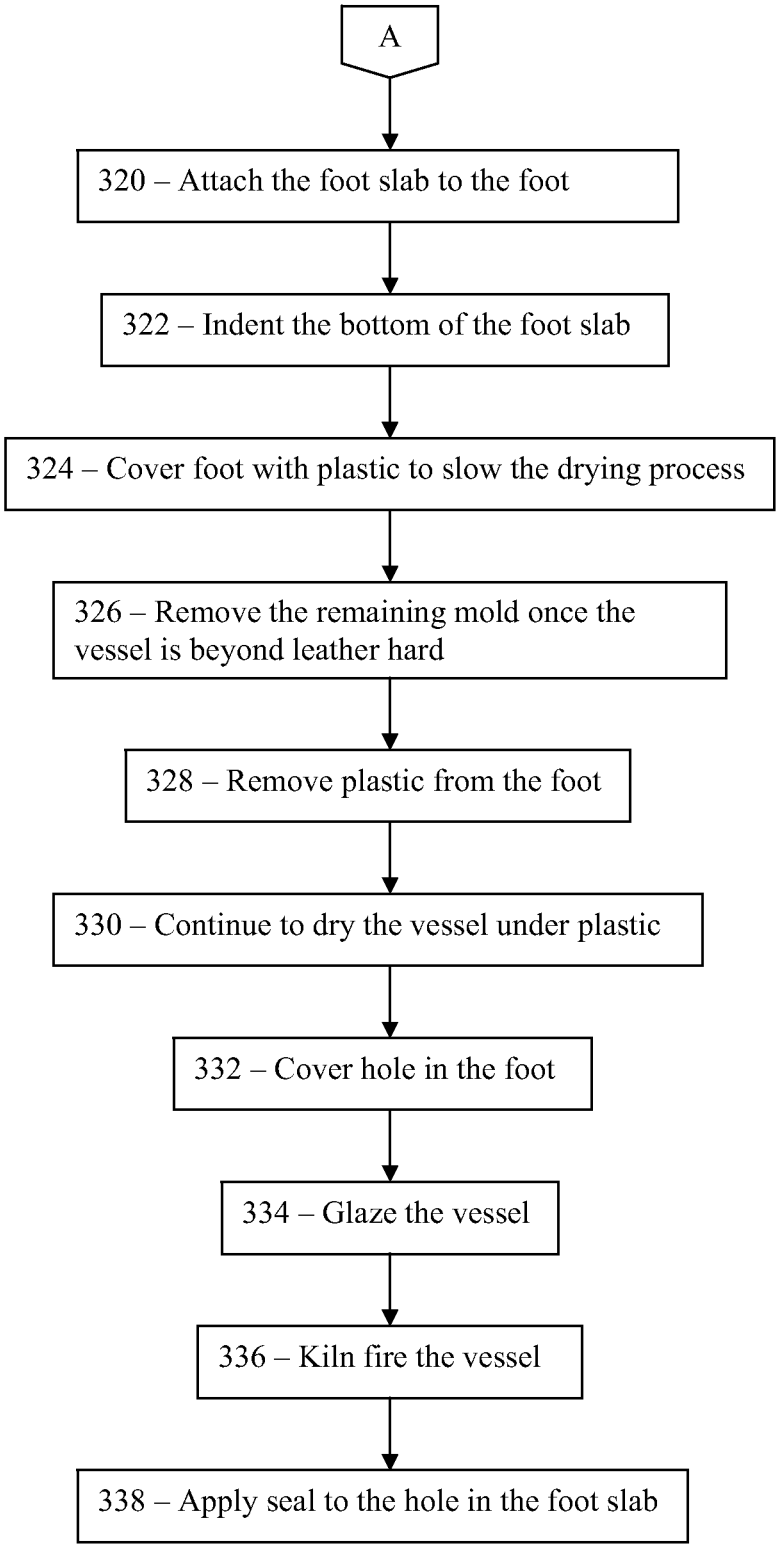
FIG. 3B is a chart depicting the second part of an embodiment of a process of the disclosure.

FIGS. 3A and 3B depict portions of process 300. The process 300 describes an embodiment of the disclosure for making pottery with a noise chamber. For illustrative purposes, the vessel 100 and the mold 200 will be referred to in conjunction with the elements of the process 300. One skilled in the art will recognize that the order of elements of process 300 may vary and remain within the scope and spirit of the present disclosure. In addition, one skilled in the art will recognize that the elements of the process 300 may vary for differing designs than those shown by the vessel 100 and the mold 200.

In box 302, slip is poured into a mold defining a vessel with a void in the foot. For example, slip is poured into mold 200. The slip fills the mold 200 including the foot mold 210 defining a foot with a void.

In box 304, the slip is allowed to cast within the mold. For example, the slip is cast in the mold 200. Casting the slip refers to hardening the slip material such that it may hold the shape of the mold. In some embodiments, the slip is allowed to cast while the mold 200 is placed in an upright position such that the foot mold 210 of the mold 200 is down.

In box 306, the excess slip is drained from the mold. For example, once the slip has sufficiently cast to the mold 200, the mold 200 is drained by turning the mold 200 upside down to remove excess slip. In some embodiments, the slip is removed using a scoop, a ladle or another device. In some embodiments, the slip may be removed using a siphoning or suctioning apparatus.

In box 308, the slip is allowed to harden upside down within the mold. For example, the mold 200 is placed upside down on a drying rack allowing the slip that has been cast in the mold 200 to continue the hardening process. Hardening the vessel body 202 upside down causes the foot portion of the vessel body 202 to dry at a faster rate than the top portion of the vessel body 202. The foot may dry faster due to gravity pulling the water in the clay downward out of the foot portion of the vessel body 202 toward the top portion in this orientation. Accordingly, the foot portion of vessel body 202 may reach a leather-hard state of drying earlier than the remainder or vessel body 200. The leather-hard state refers to a stage in drying wherein the clay has lost approximately 13-23% of its moisture.

In box 310, the mold is removed from the foot section once the foot is leather-hard. For example, the foot mold 210 is lifted from side molds 206 and 208 exposing the foot section of vessel body 202. In some embodiments, the shorter drying time of the foot relative to the top of vessel body 202 allows exposure and/or manipulation of the foot while the remainder of the vessel body 202 continues to dry in the mold 200.

In box 312, ceramic beads are created and high-fired. In some embodiments, the ceramic beads are created by pouring slip into a mold for creating one or more beads and allowing the slip to set. In some embodiments, the ceramic beads are created by cutting pieces of clay into a size and shape suitable for bouncing within the void in the foot. In some embodiments, the beads are sized at a maximum of one quarter of a centimeter in diameter. One skilled in the art will recognize that the size of the beads may vary depending on the design of the vessel or pottery and remain within the scope and spirit of the present disclosure. In some embodiments, the clay beads are high-fired to create hardened ceramic beads. In some embodiments, the process of high-firing the ceramic beads may prevent and/or limit the likelihood that the bead will absorb moisture and/or stick to clay in or around the leather-hard state. One skilled in the art will recognize that other beads, pellets, and/or small objects may be used to create a noise with the void of the foot 108 of a vessel 100 and remain within the scope and spirit of the present disclosure.

In box 314, one or more of the ceramic beads are placed in the void in the foot of vessel body 202. For example, four ceramic beads may be placed in the foot void of vessel 202. As discussed above, the ceramic beads may be high-fired to limit the likelihood that the beads stick to the foot of vessel body 202 while it is in a leather-hard state.

In box 316, a foot slab is created with a center hole. For example, slip may be poured into a mold defining a foot slab 114 with the center hole 116. In some embodiments, the foot slab 114 is designed to resemble two leveled sections, wherein the top section corresponds to the inner dimension of the bottom of foot 108 and the lower portion corresponds to the outer dimension of the bottom of foot 108. The slip may be allowed to harden in the mold until it reaches a desired state. In some embodiments, the foot slab is removed from the mold when it reaches a leather-hard state. In some embodiments, the center hole 116 is dimensioned to correlate with stopper 118. For example, the center hole 116 may be sized slightly larger than the corresponding stopper 118 to account for shrinkage of the hole during the process 300. In one embodiment, the center hole 116 may be sized around 8% larger than stopper 118 based upon the clay used in foot slab 114. One skilled in the art will recognize that the shrinkage rate may vary based upon the type of clay used and the sizing of center hole 116 may vary based upon the corresponding shrinkage rate of the clay.

In box 318, the foot and the foot slab are scored and slipped. For example, portions of foot 108 that may be adjacent to the foot slab 114 may be scored to create slight indentions in the clay of the foot 108. In addition, portions of foot slab 114 that may be adjacent to the foot 108 of vessel 100 may also be scored to create slight indentions in the clay of the foot slab 114. Slip may then be applied to the scored portions of the foot 108 and the foot slab 114.

In box 320, the foot 108 and foot slab 114 are attached. For example, the foot slab 114 is pressed into the bottom of foot 108 such that a portion of the foot slab 114 corresponding to the inner dimension of the foot 108 fits into a portion of the void in the foot 108 while another portion of foot slab 108 abuts the bottom of the foot 108. In some embodiments, scored portions of the foot 108 and foot slab 114 having slip applied to them may be in proximity such that as the slip dries the foot 108 attaches to the foot slab 114. In some embodiments, the foot 108 and foot slab 114 are attached while both components are in the leather-hard state.

In box 322, the bottom of the foot slab is indented. In some embodiments, a person may press the bottom of foot slab 114 to create a gradual indention into the foot slab 114. In some embodiments, an apparatus may be used to apply pressure to the bottom of foot slab 114 to create a gradual indention into foot slab 114. Creating the gradual indention in the foot slab 114 may affect the clay such that it is less likely to crack during the process 300 and/or use of the vessel 100. In some embodiments, the indentation is created while the foot slab 114 is in a leather-hard state.

In box 324, the foot is covered with plastic to slow the drying process. For example, the foot 108 with foot slab 114 is covered with a plastic. The covered foot 108 will dry slower due to the plastic covering. Drying the clay slower limits the likelihood of cracking during the process 300.

In box 326, the remaining mold pieces are removed when the vessel is beyond the leather-hard state. For example, the mold 200 may be placed on side mold 206 such that side mold 208 may be lifted off side mold 206 and the vessel body 202. Then the vessel body 202 may be removed from side mold 206. In some embodiments, using alternative mold designs, the process of removing the mold pieces may vary to ensure or limit the likelihood that the vessel will be damaged during the mold removal process.

In box 328, the plastic is removed from covering the foot. For example, the plastic covering the foot 108 may be removed to expose foot 108. In some embodiments, the plastic on the foot 108 is removed once the foot 108 and the remainder of the vessel 100 have reached approximately the same state of drying.

As described above, the process 300 may be implemented such that the portions of the vessel 100 are drying at different rates allowing for timely manipulation of the vessel 100 during creation and limiting the likelihood of cracking or damage during process 300. For example, allowing the clay to harden upside down allows the foot 108 to reach the workable leather-hard state before the remainder of the vessel body 102. This allows the manipulation of the foot 108 for inserting beads 120 and attaching the foot slab 114 while the remainder of the vessel body 102 continues to dry at a slower rate relative to the foot 108. The rate of drying the foot 108 is slowed down after manipulation by covering it alone with plastic allowing the vessel 100 to dry slowly. In some embodiments, the drying rate for the foot 108 will become slower than the drying rate of the remainder of the vessel 100 allowing the clay throughout the vessel 100 to reach a similar state of dryness.

In box 330, the vessel continues to dry under plastic. For example, plastic is placed over the vessel 100 allowing the vessel 100 as a whole to dry at a slower rate than it would exposed to the ambient air without the plastic covering. In some embodiments, the rate of drying the vessel 100 is consistent or semi-consistent throughout the vessel 100. In some embodiments, the lip 110 of vessel 100 is placed on a flat surface with plastic covering the vessel 100. This may allow more time for the foot slab 114 and the foot 108 of vessel 100 to fuse together. In some embodiments, a the vessel 100 is subsequently placed in a kiln to bisque fire the vessel 100 in preparation for a later glazing process.

In box 332, the center hole in the foot is covered. For example, a small ball of moist clay may be placed over the center hole 116 in foot slab 114. In some embodiments, a concealing agent, such as glue, covers the center hole 116. The center hole 116 is covered to prevent or limit the likelihood that glaze will seep into the center hole 116 and potentially into the voided area within foot 106. Temporary materials, such as the concealing agents, moist balls of clay, and/or others, are applied to cover the center hole 116 during the glazing process described below. The temporary materials may be designed to be removed at a later time by a physical process, to burn off during the process 300, and/or to be removed by an alternative process, such as a chemical removal.

In box 334, the vessel is glazed. For example, a glazing substance is applied to the vessel 100. One skilled in the art will recognize that a glazing process may include a series of steps to line and coat the vessel 100 with a vitreous substance. In some embodiments, once the process of applying the glaze is complete, the temporary cover is removed from the center hole 116 and the excess glaze is cleaned from the vessel 100. In some embodiments, the temporary cover may not be removed at this stage. For example, a concealing agent such as glue may be left covering center hole 116.

In box 336, the vessel is fired in a kiln. For example, the vessel 100 is placed in a kiln and fired. Firing hardens the vessel 100 and the glaze to create a sealed vessel 100. In some embodiments, the firing of vessel 100 burns off the temporary cover to open center hole 116. For example, a concealing agent, such as glue, may burn off during kiln firing. An open center hole 116 may improve the firing and hardening of the vessel 100 by allowing the heated air in the kiln access to the voided area in foot 108.

In box 338, a seal is applied to the hole in the foot slab. For example, a stopper 118 is inserted into center hole 116 of the foot slab 114. Sealing center hole 116 prevents and/or limits the ability for water to enter the void of foot 108. In some embodiments, stopper 118 may be adhered to center hole 116 using additional adhesive/and or fastening mechanisms. For example, epoxy may be applied to stopper 118 to adhere the stopper to the foot slab 114. In such an example, the epoxy may act as an additional water sealant to prevent liquid from passing between the foot slab 114 and the stopper 118. For another example, stopper 118 may be designed such that once pressed into the center hole 116, a lip protrudes within the void of foot 108 limiting the capability of removing the stopper 118.

One skilled in the art will recognize that one or more elements of process 300 may be optional and/or reordered and remain within the scope and spirit of the present disclosure. In some embodiments, additional elements may be included or implemented in place of elements shown in FIG. 3. For example, the creation of ceramic beads may occur prior to beginning the process of creating the vessel body 202. For another example, the foot slab 114 may be created prior to removing the foot mold 210 from the vessel body.

The invention being thus described, it will be obvious that the same may be varied in many ways. Such variations are not to be regarded as a departure from the spirit and scope of the invention and all such modifications as would be obvious to one skilled in the art are intended to be included within the scope of the method described.

The invention claimed is:

1. A method for creating a vessel with a noise chamber comprising:

pouring slip into a mold defining a vessel body with a void within a foot of the vessel body;

hardening the slip upside down within the mold;

removing the mold from the foot of the vessel body once the foot is leather-hard;

placing at least one bead within said void in the foot of the vessel body;

attaching the foot of the vessel body to a foot slab, wherein said foot slab includes a hole proximate to a center location in the foot slab and wherein the void in the foot as covered by the foot slab define said noise chamber;

creating an indention in the bottom of the foot slab;

covering the foot of the vessel body to slow drying of the foot;

removing the vessel body from the mold once the vessel is beyond leather-hard;

covering the hole in said foot slab with a temporary cover;

applying a glaze to the vessel;

firing the vessel with the glaze; and applying a seal to the hole in the foot slab.

2. The method of claim 1 wherein said mold comprises a foot mold and two side molds, wherein said foot mold facilitates molding the foot of said vessel and said two side molds facilitate the molding of the vessel body other than the foot.

3. The method of claim 1 wherein said bead comprises a high-fired ceramic bead.

4. The method of claim 3 comprising the steps of:

pouring slip into a bead mold defining a plurality of beads; and high-firing the beads.

5. The method of claim 1 wherein attaching the foot to the foot slab comprises the steps of:

scoring a portion of the foot and a portion of the foot slab along areas of each of the foot and the foot slab which will abut when the foot and the foot slab are attached;

applying slip to the scored portions of at least one of said foot and said foot slab; and engaging said foot slab with said foot.

6. The method of claim 1 wherein said foot slab comprises a first level which corresponds to an inner dimension of the foot and a second level which corresponds to an outer dimension of the foot.

7. The method of claim 1 wherein said foot slab comprises a clay material, and creating said indention in the bottom of the foot slab comprises stretching the clay toward said hole to create a concave indention.

8. The method of claim 1 wherein said temporary cover comprises at least one of a clay ball and a concealing agent.

9. The method of claim 1 comprising the step of draining excess slip from the mold once the slip has been cast within the mold.

10. The method of claim 1 wherein said seal comprises a rubber stopper sized to fit the hole in the foot slab.

11. The method of claim 1 wherein the foot becomes leather-hard prior to other parts of the vessel body.

12. A method for creating a ceramic vessel with a noise chamber comprising:

pouring slip into a mold defining a vessel body with a void within a foot of the vessel body, wherein said mold comprises a foot mold and a vessel body mold;

casting the slip within the mold;

draining excess slip from the mold;

hardening the slip upside down within the mold;

removing the foot mold from the foot of the vessel body once the slip in the foot has lost between 13 and 23 percent of the slip's moisture;

creating at least one ceramic bead using a high-fire process;

placing said at least one ceramic bead within said void in the foot of the vessel body;

attaching the foot of the vessel body to a foot slab, wherein said foot slab includes a hole proximate to a center location in the foot slab and wherein the void in the foot as covered by the foot slab define said noise chamber;

creating a concave indention in the bottom of the foot slab;

covering the foot of the vessel body to slow drying of the foot;

removing the vessel body from the mold once the vessel has lost at least 23 percent of the slip's moisture;

covering the hole in said foot slab with a temporary cover;

applying a glaze to the vessel;

firing the vessel with the glaze; and applying a seal to the hole in the foot slab.

13. The method of claim 12 wherein attaching the foot to the foot slab comprises the steps of:

scoring a portion of the foot and a portion of the foot slab along areas of each of the foot and the foot slab which will abut when the foot and the foot slab are attached;

applying slip to the scored portions of at least one of said foot and said foot slab; and engaging said foot slab with said foot.

14. The method of claim 12 wherein said foot slab comprises a first level which corresponds to an inner dimension of the foot and a second level which corresponds to an outer dimension of the foot.

15. The method of claim 12 wherein said foot slab comprises a clay material, and creating said indention in the bottom of the foot slab comprises stretching the clay toward said hole to create said concave indention.

16. The method of claim 15 wherein said the hole in the foot slab is sized in proportion to a stopper and an anticipated shrinkage rate of said clay material.

17. The method of claim 12 wherein said temporary cover comprises at least one of a clay ball and a concealing agent.

18. The method of claim 12 wherein the foot becomes leather-hard prior to other parts of the vessel body.

19. A method for creating a ceramic vessel with a noise chamber comprising:

casting slip in a mold defining a vessel body with a void within a foot of the vessel body, wherein said mold comprises a foot mold and a vessel body mold;

hardening the slip upside down within the mold;

removing the foot mold from the foot of the vessel body once the slip in the foot becomes leather-hard, wherein said foot becomes leather-hard prior to other parts of the vessel body;

placing at least one high-fired ceramic bead within said void in the foot of the vessel body;

attaching the foot of the vessel body to a foot slab, wherein said foot slab includes a hole proportioned to accept a stopper and wherein the void in the foot as covered by the foot slab define said noise chamber;

creating a concave indention in the bottom of the foot slab;

drying the slip of the foot at a slower rate than the other parts of the vessel body;

removing the vessel body from the mold once the vessel becomes beyond leather-hard;

covering the hole in said foot slab with a temporary cover;

applying a glaze to the vessel;

firing the vessel with the glaze; and applying the stopper to the hole in the foot slab.

* * * * *

UNITED STATES PATENT AND TRADEMARK OFFICE

CERTIFICATE OF CORRECTION

PATENT NO. : 9,044,877 B2
APPLICATION NO. : 13/968871
DATED : June 2, 2015
INVENTOR(S) : Ames It is certified that error appears in the above-identified patent and that said Letters Patent is hereby corrected as shown below:

In the specification,
Column 5, line 54, delete the word “a” from the phrase “a the vessel”
In the claims,
Column 8, line 27, delete the word “said” from the phrase “said the hole”

Signed and Sealed this
Twenty-second Day of December, 2015

Michelle K. Lee

Michelle K. Lee
*Director of the United States Patent and Trademark Office*